US007939236B2

(12) United States Patent
Beach et al.

(10) Patent No.: US 7,939,236 B2
(45) Date of Patent: May 10, 2011

(54) CHEMICALLY PREPARED TONER AND PROCESS THEREFOR

(75) Inventors: Bradley Leonard Beach, Lexington, KY (US); Jing X. Sun, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 900 days.

(21) Appl. No.: 11/677,838

(22) Filed: Feb. 22, 2007

(65) Prior Publication Data

US 2008/0206663 A1 Aug. 28, 2008

(51) Int. Cl.
*G03G 9/08* (2006.01)

(52) U.S. Cl. ..... 430/137.14; 430/137.1

(58) Field of Classification Search ..... 430/137.14, 430/137.1

See application file for complete search history.

(56) References Cited

U.S. PATENT DOCUMENTS

| | | | | |
|---|---|---|---|---|
| 5,378,585 | A | 1/1995 | Watanabe | |
| 5,885,743 | A * | 3/1999 | Takayanagi et al. | 430/137.11 |
| 6,531,254 | B1 | 3/2003 | Bedells et al. | |
| 6,531,256 | B1 | 3/2003 | Bedells et al. | |
| 6,991,884 | B2 | 1/2006 | Sun et al. | |
| 7,169,528 | B2 * | 1/2007 | Yoon et al. | 430/137.14 |
| 7,241,548 | B2 * | 7/2007 | Sugiyama et al. | 430/137.14 |
| 7,390,607 | B2 * | 6/2008 | Tanaka et al. | 430/137.14 |
| 2005/0196691 | A1 * | 9/2005 | Ohtani et al. | 430/137.14 |

OTHER PUBLICATIONS

Aoki, Takayoshi. "Chemical Toner Technology and the Future", IS&T's NIP19: 2003, pp. 2-4.*

* cited by examiner

*Primary Examiner* — Christopher RoDee

(57) ABSTRACT

The present disclosure relates to chemically processed toner that makes use of aqueous dispersions of release agent and/or pigment and solutions of a polymeric resin binder. The polymer solution may be prepared in an organic solvent wherein the organic solvent has some level of solubility in water. The polymer solution may then be combined with an aqueous dispersion of pigment and/or release agent which dispersions may include an aqueous polyelectrolyte and/or an aqueous dispersion of colloidal particles. This may be followed by agglomerating and forming particles of toner of a desired number and/or volume average particle size and/or degree of circularity.

21 Claims, No Drawings

CHEMICALLY PREPARED TONER AND PROCESS THEREFOR

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates to chemically prepared toner including a method of toner production employing dispersants in an aqueous/organic medium.

2. Description of the Related Art

Toner particles may be formed by the process of compounding a polymeric resin with colorants and optionally other additives. These ingredients may be blended through, for example, melt mixing. The resultant materials may then be ground and classified by size to form a powder. Toner particulate compositions may also be formed by chemical methods in which the toner particles are prepared by chemical processes such as suspension polymerization or emulsion aggregation rather than being abraded from larger sized materials by physical processes. Toner compositions so formed may be used in electrophotographic printers and copiers, such as laser printers, wherein an image may be formed via use of a latent electrostatic image which is then developed to form a visible image on a drum which may then be transferred onto a suitable substrate.

SUMMARY OF THE INVENTION

The present disclosure relates to chemically processed toner. A polymer solution may be prepared which combines a polymer resin and an organic solvent wherein the organic solvent has some level of solubility in water. The polymer solution may then be combined with an aqueous dispersion of pigment and/or release agent which dispersions may include certain dispersants. This may be followed by agglomerating and forming particles of toner having one or more of the following characteristics: a number average particle size (N) of about 3.0-7.0 microns, a volume average particle size (V) of about 4.0-8.0 microns and/or a degree of circularity of less than about 0.95.

DETAILED DESCRIPTION

It is to be understood that the invention is not limited in its application to the details of construction and the arrangement of components set forth in the following description. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The present invention relates to toner and a method of providing toner by chemical techniques. The toner may include a polymeric resin, a release agent (e.g. a wax) and a pigment. Such toner may be formed herein with a controlled number (N) and/or volume (V) average particle size distribution. The toner may also have a controlled degree of circularity, for example, a degree of circularity less than about 0.95, or a circularity in the range of about 0.80 to about 0.95, including all values and increments therein. The chemical techniques may rely upon the use of an organic solvent that has some associated level of water solubility and which may therefore form a solution with the polymeric resin and allow for mixing with an aqueous dispersion of pigment and/or wax. Such pigment and/or wax dispersion may include one or more dispersants. A generally single phase may then be formed of the resin solution and pigment and/or wax dispersion which may rely upon the addition of an aqueous based polyelectrolyte and/or an aqueous dispersion of colloidal particles. This is then followed by precipitation to form toner particles having one or more of the indicated characteristics.

Polymeric Resin

The polymer resin may comprise any resin which can be used to prepare a toner composition for use in an electrophotographic printer. A number of selection criteria may be applied to identify the polymer resins for use herein. For example, the polymeric resin that may be employed herein may first include any polymeric resin that may be soluble in the indicated organic solvent. Such polymer may therefore be present in the solvent at a level of greater than about 10% by weight, including all values and increments therein. Therefore, the polymer resin may be present in the solvent at levels of about 10% by weight to about 50% by weight. Furthermore, the polymer resin herein may also be selected based upon residual acid content, which is reference to the relative acidity of the resin. Such acidity may be due to, e.g., free carboxylic acid (—COOH) functionality. Accordingly, those polymer resins herein which may be made soluble in the organic solvent may specifically include those polymer resins with relatively low acidity (and relatively low polarity) such that solubility in a given organic solvent may be more easily achieved.

The polymeric resin may also be selected on the basis of those polymer resins that have a glass transition temperature (Tg) of less than or equal to about 75° C. (i.e. ≦75° C.). For example, the polymeric resins may include those polymers that have a Tg in the range of about 40° C. to about 75° C., including all values and increments therein. It may also be appreciated herein that the Tg values may be determined at a heating rate of about 5° C. within a differential scanning calorimeter (DSC) and the Tg value may be identified as the onset of the change in heat capacity versus temperature.

Accordingly, the polymer resins herein may specifically include condensation type polymers, which may therefore include polyesters, polyamides and/or polyurethanes, having either aliphatic or aromatic type functionality, including those having linear or branched type structures. For example, a suitable polyester resin herein may include a polyester binder resin available from KAO Corporation of Japan identified as NE701. Such polyester binder resin is reportedly a branched aromatic polyester, formed from terephthalic acid anhydride (TA), propoxylated bisphenol A, trimellitic anhydride (TMA) and 2-dodecen-1-yl succinic anhydride along with a Tg of about 55° C. to about 60° C. Other suitable polyesters available from KAO include TPESL-10 and TPESL-11. In addition, it is contemplated herein that the polymer resins may be sourced from epoxy type polymers, polysiloxanes, phenolic resins, as well as cyclic olefin copolymers. Finally, it is also contemplated herein that any and all of the resins herein may be crosslinked which crosslinking may be utilized to influence some aspect of final toner rehology.

Release Agent

The release agent may be a relatively low molecular weight polymer which may improve the release of the toner composition from a given fuser. The value of Mn may therefore be less than or equal to about 5000. The release agent's dispersion may also have an average particle size (largest particle diameter) of greater than about 100 nm. More specifically, the dispersion may have a particle size in the range of about 100 nm to about 1 micron, including all values and ranges therein.

The release agent may therefore include a wax. Waxes suitable for use in preparing the chemically prepared toners according to the invention include polyolefin waxes, metal salts of fatty acids, fatty acid esters, partially saponified fatty acid esters, higher fatty acid esters, higher alcohols, paraffin waxes, amide waxes, and polyhydric alcohol esters. The polyolefin waxes include, but are not limited to, polyolefins selected from polypropylenes, polyethylenes, polybutenes, polypropylene/polyethylene copolymers, and blends comprising polyethylenes, polypropylenes or poly-α-olefins. Suitable metal salts of fatty acids include metal salts of maleic acid adducts of saturated hydrocarbons, metal salts of stearic acid, metal salts of oleic acids, metal salts of palmitic acids, metal salts of linoleic acids and metal salts of ricinoleic acid. Suitable fatty acid esters include ethylmaleate, butylmaleate, methyl stearate, butyl stearate, cetyl palmitate, and ethylene glycol montanic acid ester. Partially saponified fatty acid esters include montanic acid esters partially saponified with calcium. Higher fatty acids esters include esters of dodecanoic acid, lauric acid, myristic acid, palmitic acid, stearic acid, oleic acid, linoleic acid, ricinoleic acid, arachic acid, behenic acid, lignoceric acid, selacholeic acid. Suitable higher alcohols include dodecyl alcohol, lauryl alcohol, myrisyl alcohol, palmityl alcohol, stearyl alcohol, arachyl alcohol, and behenyl alcohol. Suitable paraffin waxes include natural paraffins, synthetic paraffins, Fischer-Tropsch wax, rice wax, carnauba wax, and chlorinated hydrocarbons. Suitable amide waxes include stearamide, oleamide, palmitamide, lauramide, behenamide, methylene bisstearamide, and ethylene bisstearamide. Suitable polyhydric alcohol esters include glycerol stearate, glycerol ricinoleate, glycerol monobehenate, sorbitan monostearate, propylene glycol monostearate and sorbitan trioleate.

More typically the waxes may include linear or branched polyalkylene waxes such as polyethylenes, polypropylenes, ethylene propylene copolymers, and mixtures thereof. Moreover, the waxes may specifically include a synthetic wax, such as synthetic polyolefin wax. A synthetic polyolefin wax may include polyethylene wax, polypropylene wax, and mixtures thereof. The wax may therefore be free of natural waxes such as carnauba wax, rice wax, jojoba oil wax, Fischer-Tropsch wax, and bees wax. Ester wax such as WE3, WE4, WE5 from NOF Inc. Japan and Ceramer wax from Baker Hughes Inc. USA are also the types of waxes that may be used as a toner releasing agent.

Generally the melting point of the wax (Tm) may be in the range from about 60° C. to about 135° C., including all values and increments therein. The wax may be present in the agglomerated toner particles in an amount by weight ranging from about 1 to about 25% based on the total weight of the toner particles.

Pigment

The pigment may be selected from any of the pigments, dyes, etc. that are typically used in electrophotographic printers. The average particle size of the pigment dispersion herein (largest particle diameter) may be greater than 100 nm. More specifically, the particle size of the pigment dispersion herein may fall in the range of about 100 nm to 500 nm, including all values and ranges therein. Pigments may therefore be selected from organic and inorganic pigments, including but not limited to azo pigments such as azo lakes, insoluble azo pigments, condensed and chelate azo pigments; polycyclic pigments such as phthalocyanines, anthraquinones, quinacridones, thioindigoids, isoindolinones, and quinophthalones, benzimidazolones, bisacetoarylides, nitro pigments, daylight fluorescent pigments; carbonates; chromates, titanium oxides; zinc oxides; iron oxides, magnetites and carbon blacks. Preferred pigments may include carbon black, Pigment Red 122, Pigment Red 202, Pigment Yellow 74, Pigment Yellow 128, Pigment Yellow 138, Pigment Yellow 155, Pigment Yellow 180, Pigment Blue 15:3 and Pigment Blue 15:4.

The pigments may also include surface modified pigments. Surface modified pigments include pigments having grafted on the surface thereof groups which enhance the hydrophilic or hydrophobic properties of the pigments. For example, in order to increase the dispersibility of pigments in an aqueous medium, hydrophobic groups and/or hydrophilic groups may be formed on the surface of the pigments. Such groups enhance the ease of dispersing the pigments in an aqueous medium for conducting the agglomeration process described below. The pigment may be present in the agglomerated toner particles in an amount by weight ranging from about 1 to about 15% of the total weight of the toner particles.

Dispersant

The dispersant that may be employed herein for preparing either the release agent and/or pigment dispersion may include one or a mixture of dispersants. One suitable dispersant is therefore those dispersants disclosed in U.S. Pat. No. 6,991,884, whose teachings are incorporated by reference. For example, the dispersant may include a copolymer. The dispersant copolymer may include a graft co-polymer wherein the co-polymer may contain at least two components including a hydrophilic component and a protective colloid component. The copolymer may also include more than two components, such as a hydrophobic component. The copolymer may be produced via free-radical polymerization. The polymeric dispersant may have a weight average molecular weight (Mw) from about 3,000 to about 30,000 as determined by gel permeation chromatography (GPC).

The hydrophilic component of the dispersant may be understood as one which may associate with water, which may be due to the ability to ionize. For example, the hydrophilic component may include an ionic monomer segment which may be selected from acrylic acid, methacrylic acid, crotonic acid or other carboxylic acid containing monomers. The hydrophilic component may therefore provide stability or instability to the particles in the mixture of water and organic solvent, as discussed more fully below.

The hydrophobic component of the polymeric dispersant may contain electron rich functional groups. Such functional groups may therefore provide relatively strong interaction or adsorption properties with respect to particle surfaces such as the colorant and fuser release agent particles. Those groups that may provide the electron rich functional groups include nonylphenyl, mono-, di-, and tri-styrene phenyl, polydimethylsiloxy, stearyl, and fluoronated hydrocarbon containing groups. Examples of such monomers include, but are not limited to, polymerizable monofunctional vinyl monomers from Toagosei Co. of Tokyo, Japan under the trade name ARONIX M-117, mono-methacryloxypropyl terminated polydimethylsiloxane from Gelest, Inc. of Morrisville, Pa. under the trade name MCR-M11, and polydimethylsiloxane-co-polypropylene glycol methacrylate from Chisso Corporation of Tokyo, Japan.

The protective colloid component includes a moiety that enables it to attach to the backbone hydrophilic segment of the polymer. Among other things, the protective colloid component may be one that includes hydrophilic and hydrophobic segments. However, the hydrophilic segments are those that do not ionize in aqueous media while still providing stability in aqueous media and which may therefore reduce the amount of the hydrophilic monomer component noted above. The protective colloid may also stabilize the dispersion in lower acidic and in aqueous/organic media, where a carboxylic acid group may be relatively ineffective for inducing dispersion stability. The protective colloid may also act to buffer the dispersion during agglomeration which may assist to control particle size growth and size distribution of the toner particles. As noted, the protective colloid may also itself provide a hydrophobic functional group that may have relatively strong interaction for pigment or fuser release agent (wax).

The protective colloid may include materials such as hydroxylethylcellulose acrylate, hydroxyethylcellulose methacrylate, methoxypoly(ethyleneoxy) acrylate (containing from about 0 to about 40 moles of ethylene oxide), methoxypoly(ethyleneoxy) methacrylate (containing from about 0 to about 40 moles of ethylene oxide), methylcellulose acrylate, methylcellulose methacrylate, methylcellulose crotonate, and stearyloxypoly(ethyleneoxy) acrylate (containing 1 to about 40 moles of ethylene oxide). Mixtures of these materials may be used as well.

The protective colloid may be sourced from a reactive surfactant. Reactive surfactants may include nonylphenoxy poly(ethyleneoxy) acrylate (containing from about 1 to 40 moles of ethylene oxide), nonylphenoxy poly(ethyleneoxy) methacrylate (containing from 1 to about 40 moles of ethylene oxide), nonylphenoxy poly(ethyleneoxy) crotonate (containing from about 1 to about 40 moles of ethylene oxide), bis-nonylphenoxy poly(ethyleneoxy) fumerate (containing from about 1 to about 40 moles of ethylene oxide), phenoxypoly(ethyleneoxy) acrylate (containing from about 1 to about 40 moles of ethylene oxide), perfluoroheptoxypoly (propyloxy) acrylate, perfluoroheptoxypoly (propyloxy) methacrylate, sorbitol acrylate, sorbitol methacrylate, and allyl methoxy triethylene glycol ether.

Preferred protective colloid or reactive surfactants which may be used in the polymeric dispersants of the invention therefore may include polymers from stearyl acrylate, stearyl methacrylate, lauryl acrylate, lauryl methacrylate, nonylphenol acrylate, nonylphenol methacrylate, nonylphenoxy poly (ethyleneoxy)$_n$ methacrylate, wherein n is from 1 to about 40, including all values and increments therein, nonylphenoxy poly(ethyleneoxy)$_n$ acrylate, wherein n is from 1 to about 40, including all values and increments therein, methoxypoly (ethyleneoxy)$_n$ methacrylate, wherein n is from about 1 to about 40, including all increments and values therein, methoxypoly(ethyleneoxy)$_n$ acrylate, wherein n is from about 1 to about 40, including all values and increments therein, stearyloxypoly(ethyleneoxy)$_n$ methacrylate, wherein n may be from about 1 to about 20, stearyloxypoly(ethyleneoxy)$_n$ acrylate, wherein n may be from about 1 to about 20, including all increments and values therein, perfluoro or highly fluorinated $C_1$-$C_{18}$ alkyl methacrylate, perfluoro or highly fluorinated $C_1$-$C_{18}$ alkyl acrylate (such as trihydroperfluoro undecyl methacrylate and trihydroperfluoro undecyl acrylate), poly (propylene glycol) methyl ether methacrylate, poly(propylene glycol) methyl ether acrylate, poly(propylene glycol) 4-nonylphenol ether methacrylate, poly(propylene glycol) 4-nonylphenol ether acrylate, methacryloxy-trimethylsiloxy-terminated polyethylene oxide, and acryloxytrimethylsiloxy-terminated polyethylene oxide. The protective colloid groups may also include poly(alkylene glycol) 2,4,6,-tris-(1-phenylethyl) phenyl ether methacrylate and its di and mono derivatives wherein the alkylene group may contain from 2 to 10 carbon atoms. A commercially available monomer for the protective colloid groups may include poly(ethylene glycol) 2,4,6-tris-(1-phenylethyl) phenyl ether methacrylate available from Rhodia, USA of Cranbury, N.J. under the trade name SIPOMER/SEM 25.

The protective colloid or reactive surfactant itself may have a molecular weight preferably ranging from about 200 to 2,000, including all values and increments therein. The colloid or reactive surfactant segment also includes a moiety which enables it to attach to the backbone hydrophilic segment of the polymer.

As noted above, the dispersant may also include a hydrophobic backbone segment that may include at least one electron rich functional group. Such functional group may include a polymer or copolymer containing electron rich functional groups, such as aromatic groups, including but not limited to alkyl aromatic groups and substituted aromatic groups. The functional group may include nonylphenyl, mono-, di-, and tri-styrene phenyl, polydimethylsiloxy, stearyl, and fluoronated hydrocarbon containing groups. Examples of such monomers may include, but are not limited to polymerizable monofunctional vinyl monomers from Toagosei Co. of Tokyo, Japan under the trade name ARONIX M-117, mono-methacryloxypropyl terminated polydimethylsiloxane from Gelest, Inc. of Morrisville, Pa. under the tradename MCR-M11, and polydimethylsiloxane co-polypropylene glycol methacrylate, and polydimethylsiloxane co-polypropylene glycol methacrylate. Non-siloxyl hydrophobic monomers may be derived from long chain aliphatic groups, long chain alcohols, and alkyl aryl alcohols, such as strearyl or lauryl acrylate or methacrylate or nonyl phenol acrylate or methacrylate. Other preferred hydrophobic groups include polydimethylsiloxane methacrylate from Gelest, Inc., polypropylene glycol nonylphenylether acrylate from Toagosei Co. under the trade name ARONIX M-117 and polydimethylsiloxane-co-polypropylene glycol methacrylate. The hydrophobic monomer may have a molecular weight of from about 100 to about 5,000, including all values and increments therein.

The molar ratio of the hydrophilic group to the hydrophobic groups and protective colloid groups may range from about 18:1:1 to about 13:4:1.

The dispersants herein may be initially represented by the following formula:

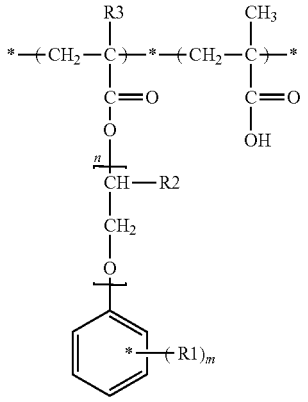

wherein n is an integer from 0 to 20, m is an integer from 1 to 3 and each R1 is independently selected from $C_1$-$C_9$ alkyl, or aryl-$C_1$-$C_9$ alkyl, provided that at least one of said R1 is aryl-$C_1$-$C_9$ alkyl and each R2 and R3 is independently selected from H and —$CH_3$. In the foregoing formula, the methacrylic acid moiety may be polymerized to provide the backbone of the dispersant. The pendant chains of the polymer may include at least one hydrophobic segment and at least one protective colloid or reactive surfactant segment as described above. It should be appreciated however, that the alkyl group of the methacrylate ester may be replaced with other functional groups such as (ethylene glycol) 2,4,6-tris-(1-phenylethyl)phenyl.

As noted above, the dispersant may also include a hydrophobic segment that may comprise a polymer or copolymer containing electron rich functional groups. Accordingly, the dispersant may be comprised of a plurality of methacrylate derivative monomers, including a substituted methacrylate ester monomer wherein an alkoxyl group on the methacrylate ester may be replaced with a siloxyl substituent, which may be represented by the following formula:

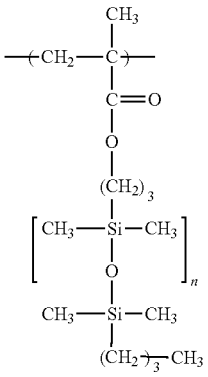

wherein n ranges from 1 to 20.

As therefore should be clear from all of the above, the dispersant herein may include random repeat units derived from a hydrophilic segment such as:

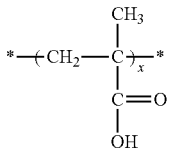

wherein x ranges from about 4 to about 20, including all increments and values therein and a segment such as:

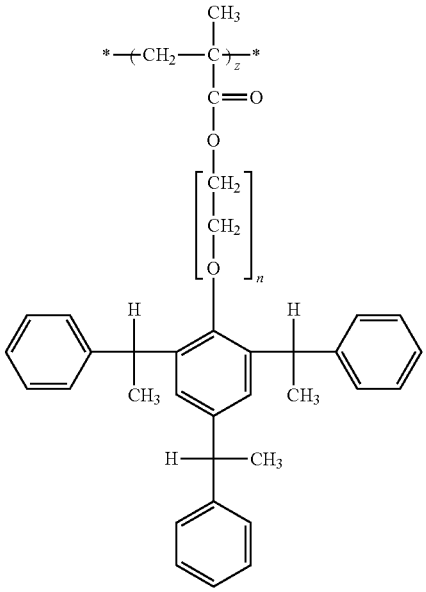

wherein z ranges from about 1 to about 5 including all increments and values therein and n ranges from about 1 to about 30, including all values and increments therein; and a segment such as:

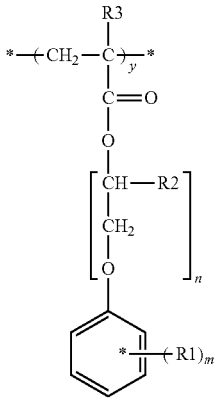

wherein y is an integer from about 1 to about 10, including all increments and values therein, n is an integer from about 1 to about 20 including all increments and values therein, m is an integer from about 1 to about 3 including all increments and values therein and each R1 may be independently selected from $C_1$-$C_9$-alkyl, or aryl-$C_1$-$C_9$-alkyl, provided that at least one of said R1 is aryl-$C_1$-$C_9$-alkyl, and each R2 and R3 may be independently selected from H and —$CH_3$.

The polymeric dispersant may be formed from corresponding monomers via free radial polymerization and may use initiators and chain transfer agents to control the polymer molecular weight and terminate the reaction. Exemplary free radical initiators may include the azo-type and peroxide-type initiators such as dimethyl 2,2'-azobisisobutyrate (V-601) from Waco Chemical & Supply Co. and 2,2'-azobisisobutyrylnitrile (AIBN) available from E.I. DuPont of Wilmington, Del. under the trade name VAZO 64. Exemplary chain transfer agents may include $C_1$-$C_{20}$ alkylthiol groups, such as n-$C_{12}$ thiol. In addition, the chain transfer agents may include phenylalkyl mercaptans or 3-mercapto-1,2 propanediol.

Aqueous Polyelectrolyte

As noted above, an aqueous polyelectrolyte may be added to the mixture of the pigment and wax dispersion when combined with the polymer solution. An aqueous polyelectrolyte may be understood as a compound such as a polymer which is itself completely soluble in water at a range of pH of 2-11, including all values and increments therein. One example of such an aqueous polyelectrolyte includes a polymeric resin containing sulfonic acid functionality (—$SO_3H$) in either homopolymer or copolymer form. For example, poly(styrene sulfonic acid) homopolymer and/or a copolymer with an organic monomer that may separately provide ionic functionality, such as maleic acid. This stabilizing agent, when specifically added to a mixture of a pigment and release agent dispersion with the polymer solution, may provide the toner particles relatively strong ionic and electron-static stabilization in the aqueous phase and therefore again stabilize the toner particles from agglomeration.

One form of an aqueous polyelectrolyte may include an aqueous soluble (ionic) dye, which may be understood as a dye having an ionic group (e.g., a carboxylic acid group or sulfonic acid group) that is water soluble. Accordingly, the aqueous soluble dyes that may be employed herein may include Reactive Red 180, Acid Yellow 17, Acid Blue 9, Direct Blue 199, etc.

Aqueous Dispersion of Colloidal Particles

As again noted above, an aqueous dispersion of colloidal particles may be added to the mixture of the pigment and release agent dispersion when combined with the polymer solution. An aqueous dispersion of colloidal particles may be understood herein as particles having an average size (largest diameter) of less than or equal to about 1000 nanometers that disperse in water. More specifically, it may include particles in the range of about 1 nanometer to about 1000 nanometers, including all values and increments therein. For example, it may include particles in the range of about 1 to 100 nanometers, or particles in the range of 10-50 nanometers, etc. One example of such an aqueous dispersion of colloid particles includes colloidal silica which is relatively stable dispersion of silica particles ($SiO_2$) in water. Such particles are available from Nissan Chemical, under the tradenames SNOWTEX™, and may be include either elongated particles (SNOWTEX-UP™) and/or string-of-pearl particles (SNOWTEX-PS™). These particles may then provide negatively charged amorphous and spherical shaped silica particles in a water environment.

Organic Solvent

The organic solvent used herein to form a solution with the polymer resin may include those organic solvents that have some level of solubility in an aqueous medium (water). It may also be understood that the formation of a solution with the polymer resin indicates that the polymer resin is dissolved into the solvent. The organic solvent may specifically have a partial solubility in water of greater than or equal to about 10% by weight (wt) including all values and increments therein. Accordingly, the organic solvent herein may have a solubility in water within the range of about 10%-50% (wt), or between about 20%-40% (wt) or between about 25%-30% (wt). A suitable organic solvent may therefore include an organic ketone, and one particular example is methyl ethyl ketone (MEK) which has a water solubility of about 28.0% (wt). Other organic solvents contemplated herein include sulfone type solvents, pyrrolidone solvents, and tetrahydrofuran.

Chemically Prepared Toner Particles

An exemplary process for making chemically prepared toner particles may be outlined as follows. The above referenced polymeric resins may be combined with the organic solvent, where as just noted, the solvent may be one that has some level of solubility in water. An aqueous dispersion may then be formed of pigment and/or release agent which dispersion may rely upon the use of one or more of the above referenced dispersants. The solution of polymer and the aqueous dispersions may then be combined and it has been found that the aqueous dispersion of pigment and/or release agent is relatively stable and can be maintained in the mixture of water and organic solvent. In addition, the mixture of such aqueous dispersions of pigment and/or release agent and polymer solution may include the addition of the above mentioned aqueous polyelectrolyte and/or the addition of the above mentioned aqueous dispersion of colloidal particles.

At this point, a relatively large amount of water may be added to dilute the dispersion containing dissolved polymer and the concentration of the organic solvent may be reduced to levels that are less than its solubility in water wherein the entire mixture may be maintained as a single phase without separation. Any upper liquid (e.g. organic/water mixture) layer that may be present may be decanted and following filtration, the toner particles having the previously indicated physical characteristics may be recovered. It is therefore worth mentioning that the above approach may avoid the need to separately disperse the release agent and/or pigment in the organic solvent.

The following examples illustrate some of the general features of the above referenced process for making chemically prepared toner.

Dispersant A

One example of a suitable polymeric dispersant may be prepared as follows. A solution of 51.9 grams of meth-acrylic acid; 248.7 g of SIPOMER SEM-25 (a tristyrlphenol polyethoxy methacrylate containing 60% active ingredient, 20% acid and 20% water); 132.08 grams of ARONIX M-117 (polypropylene glycol nonphenylether acrylate); 8.44 grams of 1-dodecanethiol; and 0.93 grams of dimethyl 2,2'-azobisisobutyrate (V-601) was mixed in 250 ml of isopropyl alcohol in a three neck round bottom flask which was equipped with a mechanical stirrer, a condenser and a thermometer. The chemicals were mixed together and degassed with nitrogen (done by repeated partial evacuation followed by backfill using a Firestone Valve). The flask was back filled with nitrogen, then immersed in an oil bath and heated to about 78° C. with stirring for about 18 hours. The product may then be dried in the oven at about 80° C. The molecular weight was determined by gel permeation chromatography (GPC). The Mw was about 20,050 and Mn was about 11,000. The resulting product was dissolved in deionized water with heating. The temperature was controlled to below about 50° C. and the pH was adjusted to 7.8 by the dropwise addition of 20% KOH to the solution.

Dispersant B

Another exemplary dispersant synthesis is as follows. About 80 grams of SIPOMER SEM-25 (a tristyrlphenol polyethoxy methacrylate containing 60% active ingredient, 20% acid and 20% water); 12.6 g ARONIX M-117 (polypropylene glycol nonphenylether acrylate); 23.6 grams of methacrylic acid; 6.4 grams of 1-dodecanethiol; and 0.30 grams of dimethyl 2,2'-azobisisobutyrate (V-601) was mixed in 80 ml of isopropyl alcohol in a three neck round bottom flask which was equipped with a mechanical stirrer, a condenser and a thermometer. The chemicals were mixed together and degassed with nitrogen (done by repeated partial evacuation followed by backfill using a Firestone Valve). The flask was back filled with nitrogen, then immersed, in an oil bath and heated to about 78° C. with stirring for about 18 hours. The product is dried in the oven at about 80° C. The molecular weight was determined by gel permeation chromatography (GPC). The Mw was about 7081 and Mn was about 3391. The resulting product was dissolved in deionized water with heating. The temperature was controlled to below 50° C. and the pH was adjusted to 7.8 by the dropwise addition of 20% KOH to the solution.

1:1 Wax Dispersion

Measure out about 26 grams (solid) dispersant and add water until the total amount of water is about 400 grams (including water in the dispersant solution). Heat the solution to 90° C. Set the Tekmar hot plate stirrer at relatively low speed (setting 1) for about a minute and then increase to a relatively high speed (setting 6). Add 26 grams of polywax 500 and maintain the temperature at about 90° C. for about 15 minutes (i.e. between about 85° C.-95° C.) while keeping the Tekmar at setting 6. Turn the microfluidizer on about 5 minutes before the Tekmar is finished to heat and then turn off right before adding the wax dispersion. Pour the wax dispersion into the microfluidizer and allow it to run for about 15 minutes or until the particle size is about 200 nm. The same procedure may used for different ratios of wax dispersions. Generally the percent solids of the dispersion may be controlled to about 10-20%.

2:1 Pigment Dispersion

Measure out about 20 grams of dispersant(s) and mix with 40 grams of the PR122 pigment (let it properly mix in) with electric stirring. Water is then added till the total percent solid is about 35%. The mixture may then be ground with an Eiger Mill (Eiger Machinery Inc.) in the media of polystyrene for about 8 hours. The particle size is about 120 nm measured by the Nanotrac, (Microtrac Inc). The final dispersion is then diluted with deionized water to a level of about 20% solids.

Polyester Solution

The polyester resin NE701 or NE2141, TPESL-10 or TPESL-11 from Kao Chemicals may be dissolved in MEK at about a 30% (wt) solid solution.

Toner Particles

One example of preparing toner particles is therefore as follows. 364 g of NE701 (30.5% solid) MEK solution is placed in a beaker with the Tekmar stirrer. It is then stirred at a speed of about 3000 rpm, followed by slowly pouring in 72 grams of the pigment dispersion (8.4 g pigment PR122 with 2:1 of the Dispersant B), and 74.5 grams of wax dispersion (6.4 g PW500 with 1:1 ratio of Dispersant B). The mixtures are well mixed in the beaker, followed by slowly pouring in about 40 grams (30%) of polystyrenesulfonic acid lithium salt with 210 g of deionized water. Stirring is then stopped. With good mechanical stirring, the above mixture is then poured in a thin stream into a beaker containing 1000 ml of deionized water and stirred for about 10 hours. The mixture is vacuum filtered and washed with acidic water and then pure water. The filtered paste is dried in the oven at about 30° C. The particle size as measured by a Coulter Counter is as follows: Number size: 5.07 μm (9% below 3 um), Volume size: 6.25 μm). The circularity as measured by a Sysmex Particle Analyzer (Sysmex Corporation) is 0.931. The more spherical the particle the closer the circularity is to 1, the more elongated or rough-edge the particle is, the lower the circularity.

A second example of toner particle preparation is as follows. 182 grams of NE2141 (30.5% solid) MEK solution is placed in a beaker on the Tekmar stirrer which is then set to a speed of about 3000 rpm. This then is followed by slowly pouring in 28 grams of the pigment dispersion (4.2 g pigment PR122 with 6:1 of the Dispersant B) and 28 grams of the wax dispersion (3.2 g PW500 with 3:1 ratio of Dispersant B). The mixtures of dispersions are then well-mixed followed by slowly pouring in 20 grams (30%) polystyrenesulfonic acid lithium salt with about 120 grams of deionized water. With good mechanical stirring the above mixture is poured as a thin stream into a beaker containing 500 ml of deionized water and stirred for 10 hours. The mixture is vacuum filtered and washed with acidic water and then pure water. The filtered paste is dried in an oven at about 30° C. The particle size by the Coulter Counter is as follows: Number size: 4.45 μm (8.4% below 3 um), Volume size: 5.20 μm.

Another set of working examples is provided below. These examples are similar to the above, but do mention the use of an aqueous dispersion of colloidal particles (e.g., silica particles).

The procedure to prepare toner particles again follows by first providing about 1000 grams of deionized water with 0.1 grams 10% acetic acid solution in a beaker. In another beaker, mix about 48 grams of the wax dispersion (PW500 wax 5.9 g with a 3:1 ratio of wax to dispersant A); 49 grams of the pigment dispersion (8.4 g pigment PR122 with 5:1 ratio of Dispersant B); and 150 g water. Under the lowest Tekmar speed, slowly pour in 355 grams of the NE701 resin solution (30.5%). After it is completely mixed, pour in the 23 grams (19%) of string-of-pearl shaped colloidal silica PSMO with 140 grams water. Stop the Tekmar. Under the speed of about 800 rpm of stirring, pour the above mixture in a thin stream to the deionized water beaker. Maintain the same speed for about 5 minutes and then lower to 350 rpm and stir for about 5 hours. The mixture is vacuum filtered to remove the liquid, the paste is washed with acidic water and water. This is followed by drying in an oven at about 30° C. The particle size by the Coulter Counter is as follows: Number size: 5.21 μm (9.63% below 3 μm), Volume size: 6.49 μm.

The following procedure is the same as above except for the use of an anionic dye as the stabilizer in the toner preparation.

The procedure to prepare toner particles again follows by first providing about 500 grams of deionized water with 0.05 grams 10% acetic acid solution in a beaker. In another beaker, mix about 24 grams of the wax dispersion (PW500 wax 2.95 g with a 3:1 ratio of wax to Dispersant A); 24.5 grams of the pigment dispersion (4.2 g pigment PR122 with 5:1 ratio Dispersant B); and 80 grams of water. Under the lowest Tekmar speed, slowly pour in 178 grams of the NE701 resin solution (30.5%). After it is completely mixed, pour in the 3 grams of Lexmark Magenta dye in 100 grams deionized water. Stop the Tekmar. Under the speed of about 800 rpm of stirring, pour the above mixture in a thin stream to the deionized water beaker. Maintain the same speed for about 5 minutes then lower to 350 rpm and stir for about 5 hours. The mixture is vacuum filtered to remove the liquid, the paste is washed with acidic water and water. This is followed by drying in an oven at about 30° C. The particle size by the Coulter Counter is as follows: Number size: 5.29 μm (12.1% below 3 μm), Volume size: 6.84 μm.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method of forming a chemically processed toner comprising:

forming a polymer solution comprising a polymer resin and an organic solvent wherein said organic solvent has a solubility in water;

combining said polymer solution with an aqueous dispersion of pigment and release agent forming a substantially single phase of said polymer solution and said pigment and release agent dispersion; and agglomerating and forming particles of toner having a number average particle size (N) of about 3.0-7.0 microns, a volume average particle size (V) of about 4.0-8.0 microns and a degree of circularity of about 0.80-0.95.

2. The method of claim 1 wherein said polymer resin has a glass transition temperature (Tg) of less than or equal to about 75° C.

3. The method of claim 1 wherein said aqueous dispersion of pigment and release agent includes a dispersant comprising a copolymer including a hydrophilic component and a protective colloid component.

4. The method of claim 3 wherein said dispersant has a weight average molecular weight (Mw) of about 3,000-30,000.

5. The chemically prepared toner of claim 3, wherein the polymeric dispersant is derived from a free radical polymerization reaction of a reaction mixture including a hydrophilic component selected from the group consisting of acrylic acid monomer and alkylacrylic acid monomer, a hydrophobic component selected from the group consisting of an alkylarylpoly($C_3$-$C_{10}$-alkylene)glycol alkylacrylate, a polydimethylsiloxane methacrylate, and a polydimethylsiloxane-co-poly($C_3$-$C_{10}$-alkylene)glycol methacrylate, and a protective colloid component selected from the group consisting of a tri-alkylarylpolyethyleneglycol alkylacrylate, and a polydimethylsiloxane-co-polyethylene glycol methacrylate.

6. The method of claim 1 wherein said aqueous dispersion of pigment and release agent includes a dispersant comprising a terpolymer including a hydrophilic component, a protective colloid component, and a hydrophobic component.

7. The method of claim 6 wherein said dispersant has a weight average molecular weight (Mw) of about 3,000-30,000.

8. The method of claim 1 wherein said combination of said polymer solution with an aqueous dispersion of pigment and release agent includes the addition of one of an aqueous polyelectrolyte or aqueous dispersion of colloidal particles.

9. The method of claim 1 wherein said release agent is selected from the group consisting of polyolefin wax, ester wax, polyester wax, metal salts of fatty acids, fatty acid esters, partially saponified fatty acid esters, higher fatty acid esters, higher alcohols, paraffin wax, amide waxes and polyhydric alcohol esters.

10. The method of claim 1 wherein said organic solvent has a solubility in water of greater than about 10% by weight.

11. The method of claim 1 wherein said polymer resin comprises a polyester.

12. A method of forming a chemically processed toner comprising:

forming a polymer solution comprising a polymer resin and an organic solvent wherein said organic solvent has a solubility in water of greater than about 10% by weight;

combining said polymer solution with an aqueous dispersion of pigment and release agent forming a substantially single phase of said polymer solution and said pigment and release agent dispersion, wherein said aqueous dispersion of pigment and release agent include a dispersant comprising a hydrophilic component and a protective colloid component having a weight average molecular weight of about 3000-30,000; and agglomerating and forming particles of toner having a number average particle size (N) of about 3.0-7.0 microns, a volume average particle size (V) of about 4.0-8.0 microns and a degree of circularity of about 0.80-0.95.

13. The method of claim 12 wherein said polymer resin has a glass transition temperature (Tg) of less than or equal to about 75° C.

14. The method of claim 12 wherein said combination of said polymer solution with an aqueous dispersion of pigment and release agent includes the addition of one of an aqueous polyelectrolyte or aqueous dispersion of colloidal particles.

15. The method of claim 12 wherein said organic solvent has a solubility in water of about 10% to about 50% by weight.

16. The method of claim 12 wherein said polymer resin comprises a polyester.

17. A method of forming a chemically processed toner comprising:

forming a release agent and pigment dispersion comprising pigment and release agent dispersed in water containing a first dispersant, said first dispersant comprising a copolymer containing a hydrophilic component and a protective colloid component having a weight average molecular weight of about 3,000-30,000;

forming a polymer solution comprising a polymer resin dissolved in an organic solvent wherein said organic solvent has a solubility in water of about 10% to 50% by weight, and wherein said polymer resin has a glass transition temperature (Tg) of less than or equal to about 75° C.;

combining said pigment and release agent dispersion with said polymer solution forming a substantially single phase of said polymer solution and said pigment and release agent dispersion including the addition of one of an aqueous polyelectrolyte or aqueous dispersion of colloidal particles; and agglomerating and forming particles of toner having a number average particle size (N) of about 3.0-7.0 microns, a volume average particle size (V) of about 4.0-8.0 microns and a degree of circularity of about 0.80-0.95.

18. The method of claim 17 wherein said organic solvent comprises a ketone solvent and said polymer resin is present in said solvent at a level of about 5% to about 50% by weight.

19. The method of claim 17 wherein said polymer resin comprises a polyester.

20. The method of claim 17 wherein said pigment dispersion comprises particles having an average size of about 100 nanometers to 500 nanometers.

21. The method of claim 17 wherein said release agent dispersion comprises particles having an average size of about 100 nanometers to about 1000 nanometers.

* * * * *